United States Patent [19]

Morris

[11] 4,271,971

[45] Jun. 9, 1981

[54] SAFETY CAP FOR CONTAINERS

[76] Inventor: Glenn H. Morris, 4203 Highwood Dr., Chattanooga, Tenn. 37415

[21] Appl. No.: 138,651

[22] Filed: Apr. 8, 1980

[51] Int. Cl.[3] ..... B65D 55/02

[52] U.S. Cl. ..... 215/220; 215/203; 215/219

[58] Field of Search ..... 215/203, 217, 219, 220

[56] References Cited

U.S. PATENT DOCUMENTS

| | | | |
|---|---|---|---|
| 2,381,207 | 8/1945 | Coleman | 215/219 X |
| 4,220,247 | 9/1980 | Kramer | 215/219 |
| 4,223,794 | 9/1980 | Morris | 215/220 |

*Primary Examiner*—George T. Hall

*Attorney, Agent, or Firm*—Brady, O'Boyle & Gates

[57] ABSTRACT

A three component safety cap for threaded containers is operated entirely in a rotational mode between positions where the cap is safe or "child-proof" or unsafe for children in that it may be removed from the threaded container by simple rotation. Optionally, the safety cap may include a visual indicator of its safe or unsafe condition. Discomfort to the fingers and particularly the fingertips is avoided.

12 Claims, 9 Drawing Figures

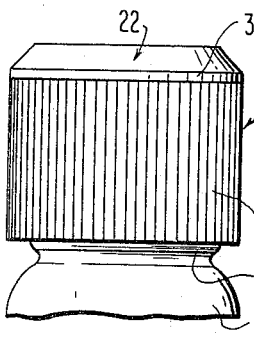
FIG. 1
FIG. 2
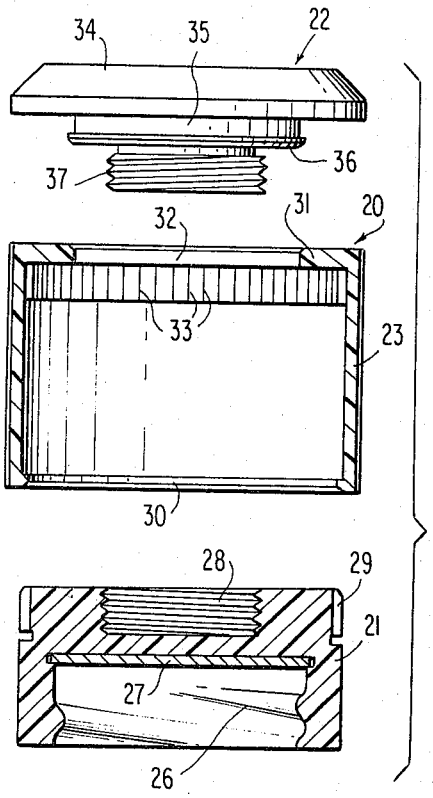
FIG. 3
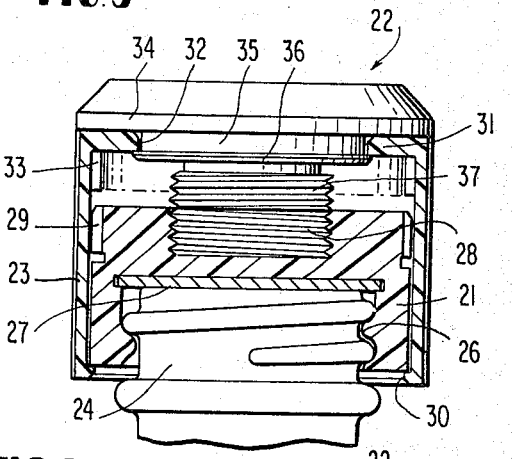
FIG. 4
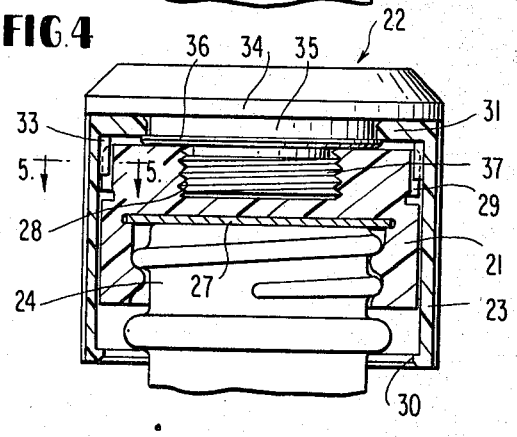
FIG. 5
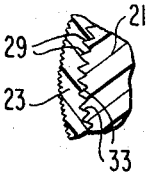
FIG. 7
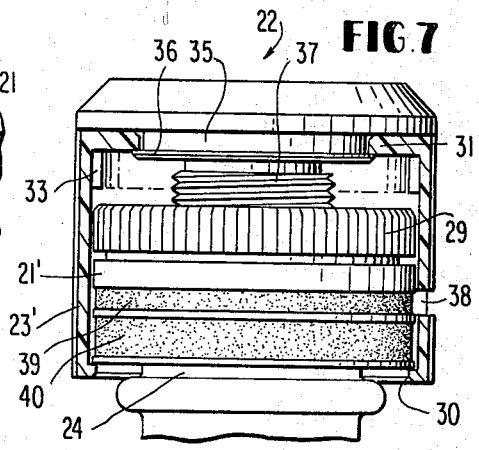
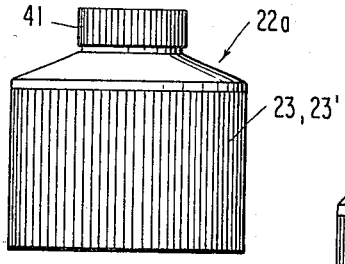
FIG. 9
FIG. 6
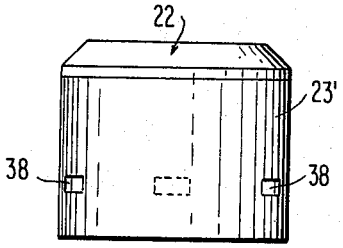
FIG. 8
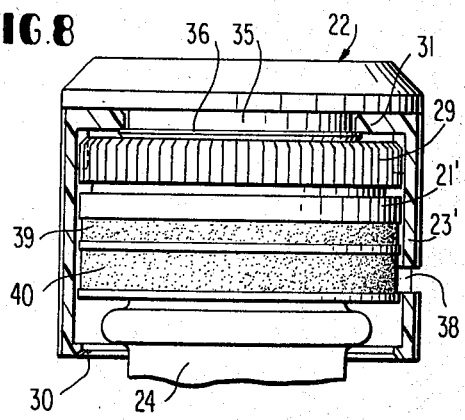

SAFETY CAP FOR CONTAINERS

BACKGROUND OF THE INVENTION

Many safety caps for medicine containers now available on the market are excessively difficult to manipulate and cause much discomfort to the hands and particularly the fingertips of those seeking to remove the caps from containers. This is particularly troublesome for the elderly who are frequent users of medicine containers.

The object of this invention is to alleviate the above difficulty in the prior art through provision of a safety cap for medicine containers and the like whose manipulation does not traumatize the hands or fingertips and which cap is operated by the user in a simple rotational mode instead of in a complex or unusual manner. This convenient and simplified mode of use in the invention is achieved without any sacrifice of security or safety in terms of the cap being adequately child-proof at required times.

SUMMARY OF THE INVENTION

The invention comprises a three component rotational safety cap for threaded containers in which an inner cap section has direct threaded engagement with the container threads and includes a threaded recess to receive a threaded extension of a rotational element whose manipulation is required to convert the cap from a safe or child-proof condition to an unsafe ready-removal condition. The inner cap section is held captive within an outer cap section which can freewheel or swivel on the inner section when the safety cap assembly is in the child-proof condition. When the safety cap is in the non-child-proof or free removal condition as dictated by the rotational element, the inner and outer cap sections are positively locked together for rotation as a unit. The relative positions axially of the inner and outer cap sections are under control of the rotational element which has threaded engagement with the inner cap section. Safe and unsafe visual indicators on the inner cap section are viewable through an opening or openings in the side wall of the outer cap section to indicate a safe or unsafe cap condition in accordance with an optional feature of the invention. The rotational element may have varied shapes to fit the preferences of users.

BRIEF DESCRIPTION OF THE DRAWINGS

FIG. 1 is a side elevation of a safety cap for containers in accordance with the invention.

FIG. 2 is an exploded central vertical cross section partly in elevation through the safety cap.

FIG. 3 is an assembled central vertical cross section through the safety cap in the safe or child-proof condition.

FIG. 4 is a similar sectional view showing the safety cap in the unsafe, easy removal condition.

FIG. 5 is an enlarged fragmentary horizontal section taken on line 5—5 of FIG. 4.

FIG. 6 is a side elevation of a safety cap having a condition indicator in accordance with a modification.

FIG. 7 is a central vertical section taken through the cap of FIG. 6 in the child-proof mode.

FIG. 8 is a view similar to FIG. 7 showing the cap in the non-child-proof mode.

FIG. 9 is a side elevation of the safety cap according to a variant of the invention applicable to the caps in FIGS. 1 and 6.

DETAILED DESCRIPTION

Referring to the drawings in detail wherein like numerals designate like parts and referring first to FIGS. 1 through 5, there is shown a safety cap 20 consisting of three coacting components, namely, an inner cap section 21, a rotational actuator element 22, and an outer cap section 23. The inner cap section 21 is adapted to be received directly on the screw-threaded neck 24 of a medicine container 25 or the like. To facilitate this, the inner cap section 21 has internal screw-threads 26 engageable with the threads of the container and also preferably has an internal seal 27 adapted to seal the mouth of the container when the inner cap section 21 is fully engaged thereon.

The inner cap section 21 is provided centrally in its end face away from the internal threads 26 and coaxial therewith with a screw-threaded recess 28. The inner cap section is further provided on its periphery in concentric relationship to the recess 28 with circumferentially spaced splines 29 shown in detail in FIG. 5.

The outer cap section 23 is adapted to receive therein captively the inner cap section 21, FIGS. 3 and 4, and the outer cap section is considerably longer axially than the inner cap section to allow necessary axial relative movement between the two cap sections during the operation of the safety cap. At its lower end, outer cap section 23 has a narrow internal annular lip 30 which retains the inner cap section 21 assembled in the outer cap section. This lip can yield sufficiently to allow the two parts to be assembled by a snap action and, once assembled, they will remain permanently together.

At its far end, the outer cap section 23 has a wider inwardly directed annular flange 31 defining a bore 32 and immediately below the flange 31 the outer cap section has internal circumferentially spaced splines 33 adapted to mesh or interfit lockingly with the external splines 29 of the inner cap at proper times.

The rotational actuator element 22 has a turning head portion 34 which rides on the flange 31 and preferably is of the same diameter as the outer cap section 23 for the sake of a clean appearance. The element 22 has a reduced cylindrical neck 35 between its ends which has free rotational engagement in the bore 32. The element 22 is snap-locked in permanently assembled relationship with the outer cap section through a radially narrow annular lip 36 provided on the actuator element 22. This lip can yield to allow assembling of the two parts 22 and 23. The rotational actuator element 22 further comprises a reduced screw-threaded end extension 37 adapted for entry into the threaded recess 28 of inner cap section 21 at proper times.

With the three components 22, 23 and 21 assembled in the described manner, the safety cap operates in the following manner.

Assuming that the inner cap section 21 is tightly engaged through its threads 26 with the threaded neck 24 of the container and it is desired to maintain the cap in a safe or child-proof condition, the rotational actuator element 22 is rotated to back off or separate the threaded extension 37 from the threaded recess 28 as shown in FIG. 3. When this occurs, the outer cap section 23 is moved axially outwardly on the inner cap section 21 to thereby cause complete separation of the splines 33 from the splines 29. The outward axial displacement of outer cap section 23 will be limited through engagement of the lip 30 with the inner end face of cap section 21. At this time, the inner cap section 21 is still secure on the threaded neck 24 while the outer cap section is rotationally freewheeling in both directions around the inner cap section so that a child will not readily be able to open the container.

When it is desired to open the container, the safety cap is readily converted to the non-child-proof, free access condition shown in FIG. 4 by simply rotating actuator element 22 in the direction to engage threaded extension 37 with the threads of recess 28 and thus move the splines 33 into full driving engagement with the cooperating splines 29. When this occurs, rotational pressure is applied to the outer cap section 23 in the usual manner for releasing any threaded cap and the two cap sections 23 and 21 will turn as a unit for easy removal of the entire cap assembly from the container.

The safety cap is reapplied to the container by normal rotational movement while the splines 33 and 29 are still engaged. When fully applied and tight, the actuator element 22 is again rotated and backed off to the child-proof position of FIG. 3 carrying the outer cap section 23 with it axially to again separate the splines 33 and 29 and render the outer cap section freewheeling on the inner cap section in both directions of rotation.

In FIGS. 6 through 8, a modification of the safety cap is shown wherein a visual indicator means is included to enable the user at a glance and without resorting to "feel" to determine whether the cap is child-proof or non-child-proof. In all other respects the construction and use of the safety cap is unchanged from the previous embodiment, and therefore the detailed description will not be repeated in connection with FIGS. 6 to 8.

In these figures, the outer cap section 23' is provided in its cylindrical side wall with one or more viewing window openings 38 through which the user can view side wall portions of the inner cap section 21'. Two axially separated indicator rings 39 and 40, preferably colored green and red respectively, are included on the inner cap section 21' to indicate, respectively, that the safety cap is child-proof or unsafe for children. When child-proof or safe, the green ring 39 is viewable through the window opening 38, FIG. 7, while the splines 29 and 33 are separated. When the safety cap is unsafe for children, the red ring 40 is viewable through the window opening 38 and the green ring 39 is concealed from view, FIG. 8, while the splines 29 and 33 are engaged. Except for the visual indicator means, the construction and operation of the safety cap is identical to the embodiment shown in FIGS. 1 to 5, as stated.

FIG. 9 shows a simple variant of the invention applicable to either embodiment. In this figure, the rotational actuator element **22*a* is provided with a reduced diameter integral turning knob 41 for further convenience of operation. All other parts of the invention in FIG. 9** remain unchanged.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A safety cap for containers comprising an inner cap section having screw-threads for rotational engagement with a threaded container, the inner cap section having an additional screw-threaded portion and having axially extending locking and driving means thereon, an outer cap section engaging over the inner cap section and being axially shiftable relative to the inner cap section and being rotatable with and relative to the inner cap section selectively at certain times, and a rotational actuator element having swiveled engagement with the outer cap section and having a screw-threaded portion for threaded engagement with said additional screw-threaded portion of the inner cap section, and the outer cap section having axially extending locking and driving means thereon which are shiftable into and out of interlocking engagement with said locking and driving means of the inner cap section in response to relative axial movements of the inner and outer cap sections induced by the rotation of said rotational actuator element.

2. A safety cap for containers as defined in claim 1, and said first and second named locking and driving means comprising cooperating splines on the exterior of the inner cap section and the interior of the outer cap section.

3. A safety cap for containers as defined in claim 1, and said screw-threaded portion of the inner cap section comprising a screw-threaded recess in one end of the inner cap section, and said screw-threaded portion of the rotational actuator element comprising a screw-threaded end extension on the rotational actuator element engageable within said screw-threaded recess, the inner cap section having its container engaging threads formed in a recess in its end face away from the rotational actuator element.

4. A safety cap for containers as defined in claim 1, and said outer cap section having at least one viewing window opening in its side wall, and a pair of axially spaced safe and non-safe indicators on the inner cap section adapted to be viewed separately and selectively through said viewing window opening.

5. A safety cap for containers as defined in claim 4, and said indicators comprising differently colored indicator rings on the exterior of the inner cap section.

6. A safety cap for containers as defined in claim 1, and said rotational actuator element having a turning head adjacent to one end face of the outer cap section and having substantially the diameter of the outer cap section.

7. A safety cap for containers as defined in claim 1, and said rotational actuator element having a turning knob thereon of substantially smaller diameter than the outer cap section.

8. A safety cap for containers as defined in claim 1, and the outer cap section having an end flange containing a bore, and said rotational actuator element having an intermediate cylindrical neck portion rotationally engaged and snap-locked in said bore by a snap-locking lip on the rotational actuator element.

9. A safety cap for containers as defined in claim 1, and the outer cap section being axially longer than the inner cap section and being held in assembled relationship with the inner cap section by a snap-locking lip on one end of the outer cap section, said lip maintaining the inner cap section captively engaged inside of the outer cap section.

10. A safety cap for containers as defined in claim 9, and the relative axial lengths of the inner and outer cap sections being such that when the inner cap section is engaged with said lip of the outer cap section said first and second named axially extending locking and driving means are fully separated.

11. A safety cap for containers comprising an inner cap section adapted to be coupled with a container to close the latter, an outer cap section engaged telescopically over the inner cap section and being capable of axial movement relative to the inner cap section, driving connecting means between the inner and outer cap sections including means to move the outer cap section axially relative to the inner cap section between active and inactive positions of the driving connecting means, the outer cap section having a viewing window opening in its side wall adjacent to the inner cap section, and the inner cap section having axially spaced safe and non-safe visual indicators thereon adapted to be viewed separately and selectively through said viewing window opening of the outer cap section.

12. A safety cap for containers as defined in claim 11, and said visual indicators comprising differently colored indicator rings on the exterior of the inner cap section.

* * * * *